US006730882B2

(12) United States Patent
Atkinson

(10) Patent No.: US 6,730,882 B2
(45) Date of Patent: May 4, 2004

(54) CHILD-SAFE DOOR LATCHING SYSTEM FOR A COOKING APPLIANCE

(75) Inventor: Wade A. Atkinson, Ooltewah, TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/186,896

(22) Filed: Jul. 2, 2002

(65) Prior Publication Data

US 2004/0004068 A1 Jan. 8, 2004

(51) Int. Cl.[7] ..... F24C 7/08

(52) U.S. Cl. ..... 219/413; 219/391; 219/493; 219/722; 219/505; 219/395; 126/197; 126/194; 292/DIG. 69; 99/325; 713/183

(58) Field of Search ..... 219/412–414, 219/391, 490–491, 393, 493–494, 482–483, 722–724, 505–510, 702, 395–397, 720; 307/142; 126/197, 194, 192; 292/DIG. 69; 99/325; 713/183; 432/250; 70/144, 77

(56) References Cited

U.S. PATENT DOCUMENTS 3,367,697 A 2/1968 Fox, Sr.
3,859,979 A * 1/1975 Gilliom ..... 126/197
4,278,862 A 7/1981 Mizuno et al.
4,300,524 A 11/1981 Elsasser
4,373,504 A 2/1983 Day
4,927,996 A 5/1990 Genbauffe et al.
5,419,305 A 5/1995 Hanley
5,530,230 A * 6/1996 Smith et al. ..... 219/723
6,079,756 A 6/2000 Phillips

* cited by examiner

*Primary Examiner*—Shawntina Fuqua
(74) *Attorney, Agent, or Firm*—Diederiks & Whitelaw, PLC

(57) ABSTRACT

A cooking appliance, such as a range, includes a cabinet within which is arranged an oven cavity that is adapted to be selectively closed by a pivotable door. A latching mechanism is provided to interconnect the door and the cabinet. The latching mechanism is movable between a locked position wherein the door is maintained closed and an unlocked position wherein the door can be pivoted to enable access to the oven cavity. The latching mechanism is operable in two distinct modes, i.e., a first mode wherein the latching mechanism is activated in conjunction with the operation of a self-clean cycle, and a second mode wherein the latching mechanism is operated independently of any other function of the cooking appliance. The second mode is particularly employed to prevent children from improperly utilizing the door as a stepping platform.

20 Claims, 1 Drawing Sheet

CHILD-SAFE DOOR LATCHING SYSTEM FOR A COOKING APPLIANCE

BACKGROUND OF THE INVENTION

1. Field of the Invention

The present invention pertains to the art of cooking appliances and, more particularly, to the incorporation of a latching system for a door of a range or under cabinet-type cooking appliance wherein a user can selectively lock an oven door independently from other operations of the appliance through a dedicated, electrically activated latching mechanism in order to at least prevent unauthorized opening of the oven door.

2. Discussion of the Prior Art

Manufactures have installed locks on oven doors of cooking appliances for some time. The function of such known locks is to prevent an untimely opening of the oven door, specifically during self-clean cycles. That is, the temperatures developed within an oven cavity during self-clean cycles are quite high such that locking arrangements are often employed to assure that the oven door is not inadvertently opened.

In one known form, a manually operated mechanical lever is employed which, when operated by a user, causes a locking mechanism to engage the oven door. While effective to a point, these locks do not prevent a user from prematurely opening the oven cavity, nor are they effective in preventing a child from opening the oven door at other times, particularly in view of the positioning of the lever at the front of the cooking appliance. Over time, manufacturers developed automatic locks, such as electrically actuated latching mechanisms, which function to secure an oven door during a self-cleaning operation. In general, these automatic locking arrangements are either time or temperature responsive. For instance, it is known to employ thermally responsive switches to cause a lock to disengage only after the temperature of the oven cavity drops below a predetermined level.

Although these known prior art arrangements are effective in preventing access to the oven cavity during self-clean modes of operation, they do not address the need to prevent the opening of an oven door at other times. That is, potential injuries stemming from accidents associated with cooking appliances are not limited to those resulting from the contact with hot surfaces. This is particularly true in the case of a slide-in range or an oven cavity positioned below a kitchen cabinet. That is, children being small in stature often seek creative means in which to access areas beyond their reach. As such, when a cooking appliance of this type is utilized, the oven door can be an attractive means for the child to use as a step in order to gain access to upper cabinetry or the like. Obviously, an oven door is not designed or intended for use in this fashion. To this end, the simple act of using the oven door as a step could result in an unfortunate accident. When a child's weight is applied to the open door, the mechanical leverage developed could, conceivably, cause the entire appliance to tip over.

Based on the above, there exists a need in the art for a child-safe door latching mechanism for a cooking appliance, specifically a range or cooking appliance incorporating a rather low-lying oven cavity. More particularly, there exists the need for an oven door latching mechanism, preferably an electrically actuated latching mechanism, which can be readily controlled independently from other operations of the cooking appliance.

SUMMARY OF THE INVENTION

The present invention is directed to a child-safe door latching mechanism for a cooking appliance including an oven cavity which is at a relatively low level within a kitchen or other cooking area. That is, the cooking appliance includes an oven cavity having an open frontal portion which is arranged below a level of a countertop and a door which is movable between an open position for accessing the oven cavity and a closed position for essentially sealing off the cavity. In accordance with the most preferred form of the invention, the cooking appliance incorporates a self-cleaning feature and an electrically actuated latching mechanism which can function in two modes of operation. The first mode is defined by a self-clean mode in which the lock is engaged for preventing access to the oven cavity while the cooking appliance is performing a self-clean cycle. The second mode constitutes a manual mode in which a user can selectively activate the lock, thereby regulating permissible movement of the door.

In accordance with a preferred embodiment of the invention, an associated control is provided on a control panel arranged on an upper portion of the cooking appliance. The control, when operated, activates the locking mechanism, thereby selectively enabling a user to prevent movement of the door regardless of the operational state of the cooking appliance. In accordance with the most preferred form of the present invention, the cooking appliance incorporates a control panel, including a plurality of control elements, located on an upper portion of the appliance and preferably above the level of the countertop to enable a user to selectively operate various features of the cooking appliance. The control panel either incorporates a dedicated control element to activate the latching mechanism or a predetermined number of the plurality of control elements are programmed such that, in addition to their primary function, e.g., establishing cooking modes, times and/or temperatures associated with the cooking appliance, have a secondary function of activating the latching mechanism. That is, the secondary function serves to enable a manufacturer or user to program a series of buttons, the operation of which activates the latching mechanism. In other words, two or more dual function control buttons can be operated simultaneously or in a preprogrammed sequence to lock/unlock the oven door. In this manner, a child, unaware of the sequence and/or unable to simply reach the controls, will be prevented from any unauthorized opening of the oven door.

Additional objects, features and advantages of the present invention will become more readily apparent from the following detailed description of a preferred embodiment when taken in conjunction with the drawings, wherein like reference numerals refer to corresponding parts in the several views.

DETAILED DESCRIPTION OF THE PREFERRED EMBODIMENTS

Figure 1:
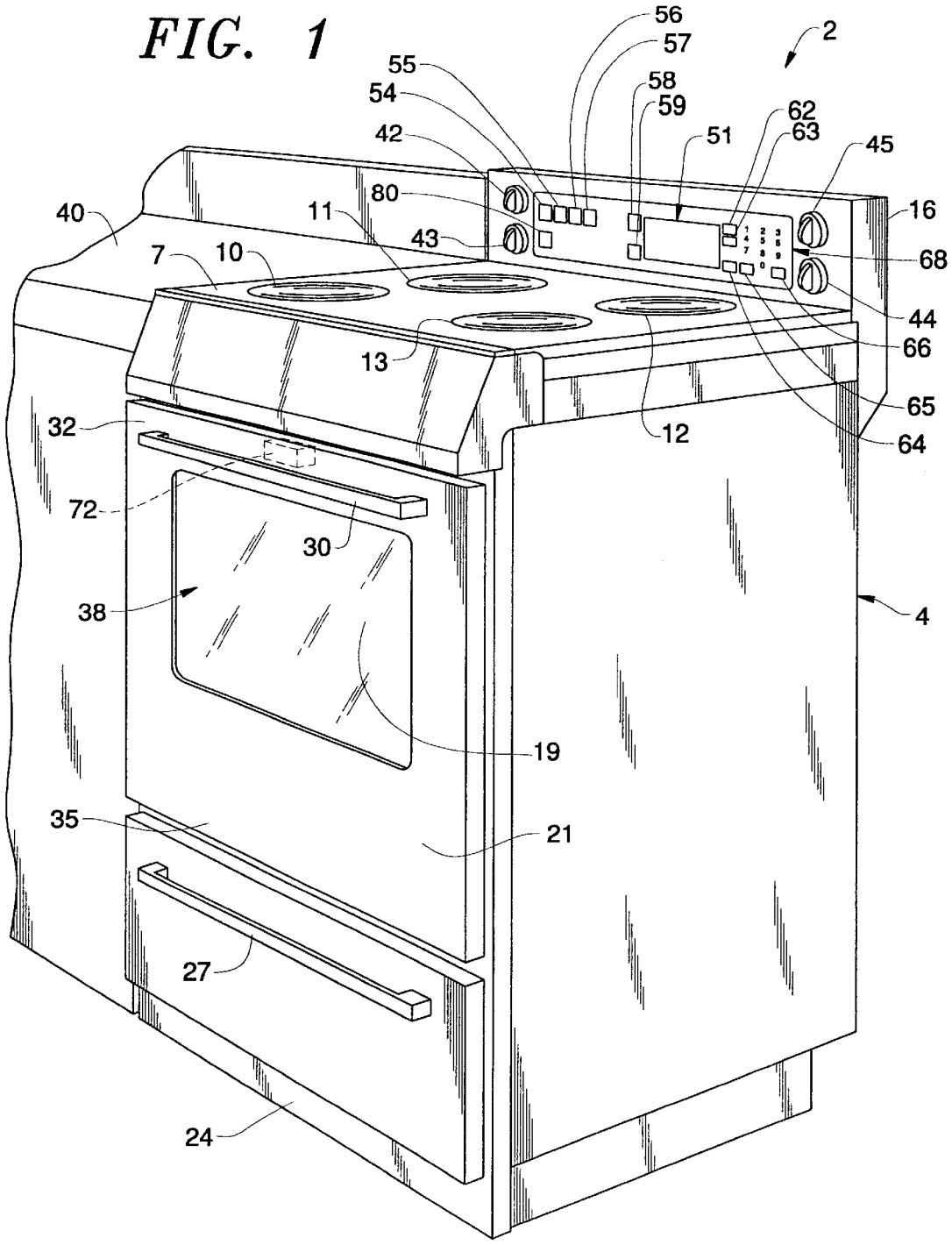
FIG. 1 is a perspective view of an oven range incorporating an automatic child-safe latching arrangement in accordance with the present invention.

With initial reference to FIG. 1, a cooking appliance 2, generally taking the form of an oven range, includes a cabinet shell 4 provided with a cooktop 7. As illustrated, appliance 2 constitutes an electric oven such that cooktop 7 is provided with a plurality of electric heating elements 10–13. In a manner known in the art, appliance 2 includes a control panel 16, an interior oven cavity 19 having an associated door 21, and a lower drawer or bin 24. More specifically, drawer or bin 24 is provided with a handle 27 and is adapted to be slid into and out of shell 4, with bin 24 defining an interior storage compartment (not shown) therein. Door 21 is also provided with a handle 30 at an upper portion 32 thereof. Door 21 is adapted to pivot at a lower portion 35 to enable selective access to oven cavity 19. In a manner also known in the art, door 21 is provided with a transparent zone 38 for viewing oven cavity 19 while door 21 is closed. At this point, it should be noted that although appliance 2 is shown to constitute an electric range, the invention is equally applicable to various other types of appliances, including gas ranges, wall ovens, and the like. Instead, it is only important to note the relevance of oven door 21 being located at a relatively low position, such as below the level of a countertop 40.

Also shown for the sake of completeness, control panel 16 includes a plurality of control knobs 42–45 for use in selectively activating and deactivating heating elements 10–13 respectively. In accordance with the most preferred embodiment of the invention, the heating of oven cavity 19 is electronically controlled such that control panel 16 includes a display zone 51, as well as a set of control elements 54–57 which enable a desired bake, broil, self-clean or keep warm operation respectively. In addition, an operational mode cancel button 58, as well as a light activation button 59, are provided on one side of display zone 51. On the opposing side of display zone 51, there is provided additional control elements which take the form of an operating set button 62, a timer button 63, cook and stop time buttons 64 and 65, a clock button 66 and a numerical keypad 68.

In general, the above-described structure of appliance 2 is known in the art and is only provided here for the sake of completeness. The present invention is particularly directed to the incorporation of an electrically actuated latching mechanism, generally indicated at 72, which is adapted to selectively interconnect door 21 and cabinet shell 4. In accordance with the present invention, latching mechanism 72 is movable between a locked position, wherein door 21 is maintained closed, and an unlocked position, wherein door 21 is free to pivot about lower portion 35. In a preferred form of the invention, electrically actuated latching mechanism 72 is in the form of a motorized lock of a type known in the art. However, it should be noted that a solenoid lock or any type of electrically controlled lock is acceptable.

In the embodiment depicted, latching mechanism 72 is mounted to cabinet shell 4 behind upper portion 32 of door 21. Upon activation, a locking element (not separately shown) of latching mechanism 72 projects away from cabinet shell 4 and engages upper portion 32 of door 21, thereby preventing door 21 from movement about lower portion 35. Of course, latching mechanism 72 could also be carried by upper portion 32 of door 21 and, upon activation, engage cabinet 4. In any case, having described a preferred arrangement for latching mechanism 72, it should be readily understood that the particular mounting location of latching mechanism 72 is not vital as long as latching mechanism 72 will prevent door 21 from undesirably opening when in the locked position.

Figure 2:
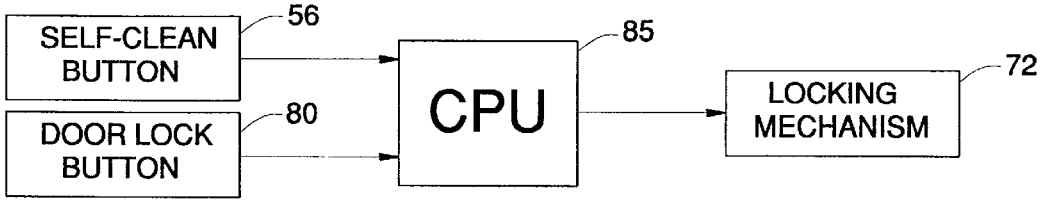
FIG. 2 is a block diagram depicting the operation of the child-safe latching arrangement in accordance with the present invention.

In a preferred form of the present invention, latching mechanism 72 is operable in two distinct modes, i.e., a first mode wherein latching mechanism 72 is placed in the locked mode or position upon establishing a self-clean cycle for cooking appliance 2 through control element 56, and a second mode wherein latching mechanism 72 is placed in the locked mode through activation of an independent control element 80 provided on control panel 16. During a self-clean cycle, high temperatures develop within oven cavity 19 such that it is desirable to prevent access to oven cavity 19 during the course of the self-clean cycle, as is known in the art. However, at various times and under certain conditions when door 21 may be inappropriately opened and used as a stepping platform by a child, it will also be desirable to lock door 21 without requiring operation of cooking appliance 2. As such, latching mechanism 72 can be selectively shifted simply through operation of control element 80. In this manner, latching mechanism 72 is moved to the locked position such that door 21 is prevented from pivotal movement about lower portion 35. When access to interior cavity 19 is again desired, further operation of control element 60 will function to release latching mechanism 72, thereby causing latching mechanism 72 to again assume an unlocked position wherein door 21 can be pivoted about lower portion 35. These modes are preferably established through the interconnection of latching mechanism 72, as well as self-clean and door lock buttons 56 and 80 respectively, with a CPU 85 as generically illustrated in FIG. 2.

In another form of the invention, the second mode of operation is achieved through the use of a predetermined number of control elements 54–59 and/or 62–65. That is, CPU 85 is linked to the overall control panel 16 for programming and regulating the functions of cooking appliance 2. In accordance with this embodiment, select ones of the plurality of control elements are designated such that, in addition to their primary function, i.e., establishing cooking modes, times and/or temperatures associated with the cooking appliance, the control elements have a secondary function of activating latching mechanism 72. That is, the secondary function serves to enable a user to engage a series of buttons, the operation of which activates latching mechanism 72. In other words, two or more dual function control buttons can be operated simultaneously or in a preprogrammed sequence, to lock/unlock the oven door. This control feature is preferably preprogrammed into cooking appliance 2, but provisions could be made for reprogramming by the consumer. In any case, access to oven cavity 19 is permitted only to those individuals with knowledge of the code or sequence. Therefore, other individuals, particularly children, can be prevented from opening door 21 such that door 21 is not subjected to any undesired use.

Although described with reference to a preferred embodiment of the invention, it should be readily understood that various changes and/or modifications can be made to the invention without departing from the spirit thereof. For instance, the control sequence can be constituted by a single control element. In general, the invention is only intended to be limited by the scope of the following claims.

I claim:

1. A cooking appliance capable of performing a self-clean cycle comprising:

a cabinet;

an oven cavity arranged within the cabinet, said oven cavity including an interior portion adapted to receive food items, and an open frontal portion;

a door mounted for movement between an open position, wherein access to within the cavity is permitted through the open frontal portion, and a closed position, wherein the door extends across the open frontal portion;

a control panel including a plurality of control elements for establishing a desired operation for the cooking appliance; and an electrically actuated latching mechanism for interconnecting the door and the cabinet, said electrically actuated latching mechanism being movable between a locked position, wherein the door is maintained in the closed position relative to the cabinet thereby preventing access to the oven cavity, and an unlocked position, wherein the door can be shifted relative to the cabinet in order to access the oven cavity, said electrically actuated latch being operable in a first mode, wherein the latching mechanism is automatically placed in the locked position for a self-clean cycle, and a second mode, wherein the latching mechanism is selectively placed in the locked position through a predetermined number of the control elements on the control panel, independent of any self-clean cycle.

2. The cooking appliance according to claim 1, wherein the control panel is provided with a dedicated control element for placing the latching mechanism in the locked position.

3. The cooking appliance according to claim 1, wherein each of the predetermined number of control elements has a primary function other than activation of the latching mechanism.

4. The cooking appliance according to claim 3, wherein activation of the latching mechanism is achieved through operation of the plurality of control elements in a programmed sequence.

5. The cooking appliance according to claim 3, wherein activation of the latching mechanism is achieved through operation of the plurality of control elements simultaneously.

6. A cooking appliance comprising:

a cabinet;

an oven cavity arranged within the cabinet, said oven cavity including an interior portion adapted to receive food items, and an open frontal portion;

a door mounted for movement between an open position, wherein access to within the oven cavity is permitted through the open frontal portion, and a closed position, wherein the door extends across the open frontal portion;

an electrically actuated latching mechanism adapted to interconnect the door and the cabinet, said electrically actuated latching mechanism being movable between a locked position which interconnects the door and the cabinet, and an unlocked position which enables movement of the door relative to the cabinet; and means for controlling activation of the electrically actuated latching mechanism in a first mode wherein the controlling means automatically activates the latching mechanism in conjunction with the activation of a self-clean cycle, and a second mode wherein the controlling means enables independent and selective activation of the latching mechanism.

7. The cooking appliance according to claim 6, wherein the controlling means includes a dedicated control element for placing the latching mechanism in the locked position.

8. The cooking appliance according to claim 6, wherein the controlling means includes a plurality of control elements, with each of the plurality of control elements has a primary function other than activation of the latching mechanism and a secondary function for activating the latching mechanism.

9. The cooking appliance according to claim 8, wherein activation of the latching mechanism is achieved through operation of the plurality of control elements in a programmed sequence.

10. The cooking appliance according to claim 8, wherein activation of the latching mechanism is achieved through operation of the plurality of control elements simultaneously.

11. A cooking appliance comprising:

a cabinet;

an oven cavity arranged within the cabinet, said oven cavity including an interior portion adapted to be heated, and an open frontal portion;

a door mounted for movement between an open position, wherein access to within the cavity is permitted through the open frontal portion, and a closed position, wherein the door extends across the open frontal portion;

a control panel including a plurality of control elements for establishing various heating functions associated with operation of the cooking appliance; and an electrically actuated latching mechanism for interconnecting the door and the cabinet, said latching mechanism being movable between a locked position which precludes movement of the door thereby preventing access to the oven cavity, and an unlocked position which enables movement of the door to access the oven cavity, wherein said latching mechanism is selectively operable independent of the heating functions of the cooking appliance.

12. The cooking appliance according to claim 11, wherein the control panel is provided with a dedicated control element for placing the latching mechanism in the locked position.

13. The cooking appliance according to claim 11, wherein each of the plurality of control elements has a primary function other than activation of the latching mechanism, but wherein activation of the latching mechanism is performed utilizing at least one of the plurality of control elements.

14. The cooking appliance according to claim 13, wherein activation of the latching mechanism is achieved through operation of the plurality of control elements in a programmed sequence.

15. The cooking appliance according to claim 13, wherein activation of the latching mechanism is achieved through operation of the plurality of control elements simultaneously.

16. A method of selectively locking an oven door of a cooking appliance comprising:

closing the oven door across a frontal opening of an oven cavity; and selectively, electrically activating a latching mechanism through at least one of a plurality of control elements provided on a control panel of the cooking appliance, independent of any heating functions of the cooking appliance, in order to lock the oven door closed.

17. The method of claim 16, further comprising: activating the latching mechanism through a dedicated control element provided on the control panel.

18. The method of claim 16, further comprising: utilizing the at least one of the plurality of control elements to perform another, primary function for the cooking appliance.

19. The method of claim 18, further comprising: activating the latching mechanism through operation of the plurality of control elements in a programmed sequence.

20. The method of claim 18, further comprising: activating the latching mechanism through operation of the plurality of control elements simultaneously.

* * * * *